US007727890B2

(12) United States Patent
Edelstein et al.

(10) Patent No.: US 7,727,890 B2
(45) Date of Patent: Jun. 1, 2010

(54) HIGH ASPECT RATIO ELECTROPLATED METAL FEATURE AND METHOD

(75) Inventors: Daniel C. Edelstein, White Plains, NY (US); Keith Kwong Hon Wong, Wappingers Falls, NY (US); Chih-Chao Yang, Glenmont, NY (US); Haining S. Yang, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 171 days.

(21) Appl. No.: 11/953,359

(22) Filed: Dec. 10, 2007

(65) Prior Publication Data

US 2009/0148677 A1 Jun. 11, 2009

(51) Int. Cl.
*H01L 21/44* (2006.01)

(52) U.S. Cl. ..... 438/687; 438/627; 438/633; 438/637; 438/653; 438/678; 257/E21.169; 257/E21.577

(58) Field of Classification Search ..... 438/650, 438/661, 679
See application file for complete search history.

(56) References Cited

U.S. PATENT DOCUMENTS 5,969,422 A 10/1999 Ting et al.
6,518,668 B2 2/2003 Cohen
6,565,729 B2 5/2003 Chen et al.
6,610,151 B1 8/2003 Cohen
6,709,562 B1 3/2004 Andricacos et al.
6,755,958 B2 6/2004 Datta
6,793,796 B2 9/2004 Reid et al.
6,806,186 B2 10/2004 Chen et al.
6,946,065 B1 9/2005 Mayer et al.
6,946,716 B2 9/2005 Andricacos et al.
7,105,434 B2 9/2006 Cohen
7,115,196 B2 10/2006 Chen et al.
7,144,490 B2 12/2006 Cheng et al.
7,190,079 B2 3/2007 Andricacos et al.
7,199,052 B2 4/2007 Cohen
2001/0005056 A1* 6/2001 Cohen ..... 257/751
2005/0274621 A1 12/2005 Sun et al.
2007/0020904 A1* 1/2007 Stora ..... 438/597

* cited by examiner

*Primary Examiner*—N Drew Richards
*Assistant Examiner*—Kyoung Lee
(74) *Attorney, Agent, or Firm*—Gibb I.P. Law Firm, LLC

(57) ABSTRACT

Disclosed are embodiments of an improved high aspect ratio electroplated metal structure (e.g., a copper or copper alloy interconnect, such as a back end of the line (BEOL) or middle of the line (MOL) contact) in which the electroplated metal fill material is free from seams and/or voids. Also, disclosed are embodiments of a method of forming such an electroplated metal structure by lining a high aspect ratio opening (e.g., a high aspect ratio via or trench) with a metal-plating seed layer and, then, forming a protective layer over the portion of the metal-plating seed layer adjacent to the opening sidewalls so that subsequent electroplating occurs only from the bottom surface of the opening up.

22 Claims, 10 Drawing Sheets

HIGH ASPECT RATIO ELECTROPLATED METAL FEATURE AND METHOD

BACKGROUND

1. Field of the Invention

The embodiments of the invention generally relate to electroplated metal integrated circuit features and, more particularly, to a structure and method for an improved high aspect ratio electroplated metal structure, such as a copper or copper alloy interconnect, for a semiconductor device.

2. Description of the Related Art

A semiconductor device, such as a field effect transistor (FET), is often formed with both back end of the line (BEOL) contacts to the gate and source/drain regions of the device to turn the device on/off and to allow current to flow through the device, respectively, and a middle of the line (MOL) contact to the body of the device between the source/drain regions to adjust threshold voltage (Vt). Traditionally, conductive metals, such as Tungsten (W) and Aluminum (Al) have been deposited (e.g., by chemical vapor deposition (CVD), sputtering, etc.) into patterned vias in order to form both MOL and BEOL contacts. Recently, because of its lower electrical resistivity copper and copper alloys, which require plating, have become the preferred metal for filling BEOL contacts and have also become the subject of new development and research for filling MOL contacts.

Unfortunately, as circuit densities are increased, the aspect ratios for both MOL and BEOL contacts has increased and adequately plating such high aspect ratio contacts has proven difficult. Specifically, as circuit densities increase and device sizes are scaled, the width of both MOL and BEOL contacts is decreased; however, the thickness of the dielectric layers in which these contacts are formed has remained the same. Consequently, increased circuit densities have resulted in high aspect ratio contacts (i.e., contacts with high height to width ratios). For example, circuit designers currently require MOL and BEOL contacts with aspect ratios that are greater than 6:1 and oftentimes greater than 10:1. When conventional plating techniques are used to fill these high aspect ratio vias, seams and voids develop within the contact structure and these seams and voids inevitably affect contact performance. Therefore, there is a need in the art for an improved high aspect ratio electroplated metal structure, such as a copper or copper alloy contact, and method of forming such an electroplated metal structure.

SUMMARY

In view of the foregoing, disclosed herein are embodiments of an improved high aspect ratio electroplated metal structure (e.g., a copper or copper alloy interconnect, such as a back end of the line (BEOL) or middle of the line (MOL) contact) in which the electroplated metal fill material is free from seams and/or voids. Also, disclosed are embodiments of a method of forming such an electroplated metal structure by lining a high aspect ratio opening (e.g., a high aspect ratio via or trench) with a metal-plating seed layer and, then, forming a protective layer over the portion of the metal-plating seed layer adjacent to the opening sidewalls so that subsequent electroplating occurs only from the bottom surface of the opening up.

A general structure embodiment of the present invention comprises an electroplated metal integrated circuit feature. This metal feature can comprise a substrate and a dielectric layer adjacent the substrate. An opening (e.g., a via, trench, etc.), having sidewalls and a bottom surface, can extend through the dielectric layer to the substrate. This opening can have a high aspect ratio (i.e., an aspect ratio greater than approximately 6:1. A metal-plating seed layer can line the opening and an electroplated layer comprising a metal or a metal alloy can fill the opening. The metal-plating seed layer can be adapted to promote electroplating of the metal or metal alloy.

An optional barrier layer can line the opening between the dielectric layer and the metal-plating seed layer in order to prevent metal out-diffusion. Additionally, an optional adhesion layer can line the opening between the optional barrier layer and the metal-plating seed layer in order to promote adhesion of the metal-plating seed layer to the optional barrier layer.

Another aspect of this electroplated metal feature is a protective layer that is positioned over the portion of the metal-plating seed layer adjacent to the opening sidewalls so that the metal or metal alloy is prevented from being electroplated onto the opening sidewalls and is only electroplated from the bottom surface of the opening up. Electroplating only from the bottom surface up avoids a prior art "pinch-off" problem (i.e., avoids materials plated on the upper sidewalls of the opening from merging and leaving seams and/or voids below).

Specifically, the metal-plating seed layer can line the opening such that it comprises a first portion adjacent to the sidewalls of the opening and a second portion adjacent to the bottom surface of the opening. This metal-plating seed layer can be adapted to selectively promote electroplating of the metal or metal alloy. The protective layer can be positioned adjacent to the first portion of the metal-plating seed layer, but not the second portion. That is, the protective layer can cover the first portion of the metal-plating seed layer on the opening sidewalls, leaving the second portion of the metal-plating seed layer on the bottom surface of the opening exposed. This protective layer can be adapted to selectively prevent electroplating of the metal or metal alloy. For example, the protective layer can comprise an additional metal layer or an additional dielectric layer that has a metal-plating over-potential that is sufficient to selectively prevent electroplating of the metal or metal alloy.

The electroplated metal or metal alloy layer can be positioned adjacent to the protective layer at the opening sidewalls as well as adjacent to the second portion of the metal-plating seed layer at the bottom surface of the opening such that it fills the opening. However, due to the protective layer, the electroplated metal or metal alloy is only electroplated onto the exposed metal-plating seed layer at the bottom surface of the opening. Since the opening is filled with the metal or metal alloy from the bottom surface up (i.e., not from the sidewalls inward), no "pinch-off" occurs and the electroplated metal or metal alloy layer is free from seams and voids.

A particular structure embodiment of the present invention comprises an interconnect (e.g., a copper or copper alloy-plated BEOL or MOL contact). This interconnect can comprise a substrate and a dielectric layer adjacent the substrate. An opening (e.g., a via, trench, etc.), having sidewalls and a bottom surface, can extend through the dielectric layer to the substrate. This opening can have a high aspect ratio (i.e., an aspect ratio of greater than approximately 6:1). A copper-plating seed layer can line the opening and an electroplated layer comprising a copper or copper alloy can fill the opening. The copper-plating seed layer can be adapted to selectively promote electroplating of copper or the copper alloy. For example, the copper-plating seed layer can comprise an approximately 5-40 nm thick conformal layer of copper, a copper alloy, iridium, an iridium alloy, ruthenium, a ruthenium alloy (e.g., tantalum ruthenium) or any other suitable nobel metal or nobel metal alloy which would selectively promote electroplating of copper or the copper alloy.

It should be noted that a barrier layer can line the opening between the dielectric layer and the copper-plating seed layer to prohibit copper outdiffusion. For example, the barrier layer can comprise an approximately 3-10 nm thick conformal layer of titanium, titanium nitride, titanium silicon nitride, tantalum, tantalum nitride, tantalum silicon nitride, tungsten, tungsten nitride, tungsten silicon nitride or any other suitable metal or metal alloy adapted to prevent copper outdiffusion. Additionally, an optional adhesion layer can line the opening between the barrier layer and the copper-plating seed layer in order to promote adhesion of the copper-plating seed layer to the barrier layer. For example, the adhesion layer can comprise an approximately 3-10 nm thick conformal layer of tantalum, ruthenium, a tantalum ruthenium alloy or any other suitable metal or metal alloy adapted to promote adhesion of the copper-plating seed layer to the barrier layer.

Another aspect of this copper or copper alloy-plated interconnect is a protective layer that is positioned over the portion of the copper-plating seed layer adjacent to the opening sidewalls so that the copper or copper alloy is prevented from being electroplated onto the opening sidewalls and is only electroplated from the bottom surface of the opening up. Electroplating only from the bottom surface up avoids a prior art "pinch-off" problem (i.e., avoids materials plated on the upper sidewalls of the opening from merging and leaving seams and/or voids below).

Specifically, the copper-plating seed layer can line the opening such that it comprises a first portion adjacent to the sidewalls of the opening and a second portion adjacent to the bottom surface of the opening. As discussed above, this copper-plating seed layer can be adapted to selectively promote electroplating of copper or the copper alloy. The protective layer can be positioned adjacent to the first portion of the copper-plating seed layer, but not the second portion. That is, the protective layer can cover the first portion of the copper-plating seed layer on the opening sidewalls, leaving the second portion of the copper-plating seed layer on the bottom surface of the opening exposed. This protective layer can be adapted to selectively prevent electroplating of copper or the copper alloy. For example, the protective layer can comprise a thin (e.g., an approximately 1.5-10 nm thick) conformal additional metal (e.g., tantalum, tungsten, titanium, chromium or any other suitable metal or metal alloy) or dielectric (e.g., oxide or nitride) layer that has a copper-plating over-potential sufficient to selectively prevent electroplating of copper or the copper alloy (i.e., the additional metal or dielectric layer has a high copper-plating over-potential).

The electroplated copper or copper alloy layer can be positioned adjacent to the protective layer at the opening sidewalls as well as adjacent to the second portion of the copper-plating seed layer at the bottom surface of the opening such that it fills the opening. However, due to the protective layer, the copper or copper alloy is only electroplated onto the exposed copper-plating seed layer at the bottom surface of the opening. Since the opening is filled with the copper or copper alloy from the bottom surface up (i.e., not from the sidewalls inward), no "pinch-off" occurs and the electroplated copper or copper alloy layer is free from seams and voids.

Also, disclosed are method embodiments for forming the general and specific structure embodiments, described above. Specifically, a method embodiment for forming the above-described electroplated metal integrated circuit feature comprises first providing a substrate and forming a dielectric layer, having a predetermined thickness, on the substrate. Next, a high aspect ratio opening (i.e., a high aspect ratio via, a high aspect ratio trench, etc.) is patterned and etched through the dielectric layer. Specifically, the opening is etched such that the aspect ratio of the opening is greater than approximately 6:1 (i.e., such that the height of the opening, which is equal to the thickness of the dielectric layer, is greater than approximately 6 times the width of the opening).

After the opening is etched, it can be lined with an optional barrier layer as well as an adhesion layer. Next, the opening can be lined with a metal-plating seed layer adapted to selectively promote electroplating of a pre-selected metal or metal alloy that will subsequently be electroplated onto the metal-plating seed layer in order to fill the opening.

Once the metal-plating seed layer is formed, a thin conformal protective layer that selectively prevents electroplating of the pre-selected metal or metal alloy is formed on the metal-plating seed layer. Specifically, a thin conformal layer of either an additional metal or an additional dielectric material is deposited onto the metal-plating seed layer such that it lines the opening. This additional dielectric or metal layer can, for example, be pre-selected such that it has a metal-plating over-potential sufficient to selectively prevent electroplating of the metal or the metal alloy. Then, the protective layer on the bottom surface of the opening is removed (e.g., by using a directional etch process) so as to expose the metal-plating seed layer at the bottom of the opening, but leave covered the metal-plating seed layer on the opening sidewalls.

Once the metal-plating seed layer at the bottom surface of the opening is exposed, an electroplating process is performed in order to fill the opening with an electroplated layer comprising the pre-selected metal or metal alloy. During this electroplating process, the protective layer on sidewalls of the opening selectively prevents electroplating of the metal or metal alloy and the exposed portion of the metal-plating seed layer at the bottom surface of the opening promotes electroplating of the metal or metal alloy such that the electroplating process fills the opening with the electroplated layer from the bottom surface up. Since the opening is filled with the metal or metal alloy from the bottom surface up (i.e., not from the sidewalls inward), no "pinch-off" can occur and the electroplated metal or metal alloy layer is free from seams and voids.

A method embodiment for forming the above-described copper or copper alloy-plated interconnect similarly comprises first providing a substrate and forming a dielectric layer, having a predetermined thickness, on the substrate. Next, a high aspect ratio opening (i.e., a high aspect ratio via, a high aspect ratio trench, etc.) is patterned and etched through the dielectric layer. Specifically, the opening is etched such that the aspect ratio of the opening is greater than approximately 6:1 (i.e., such that the height of the opening, which is equal to the thickness of the dielectric layer, is greater than approximately 6 times the width of the opening).

After the opening is etched, it can be lined with a thin barrier layer adapted to prevent copper out-diffusion. For example, an approximately 3-10 nm thick conformal layer of titanium, titanium nitride, titanium silicon nitride, tantalum, tantalum nitride, tantalum silicon nitride, tungsten, tungsten nitride, tungsten silicon nitride or any other metal or metal alloy sufficient to prevent copper out-diffusion can be deposited. Depending upon the aspect ratio of the opening this thin barrier layer can be deposited by physical vapor deposition (PVD), chemical vapor deposition (CVD) and atomic layer deposition (ALD). Those skilled in the art will recognize that PVD deposition may be more suitable for relatively low aspect ratio openings, whereas ALD may be more suitable for relatively high aspect ratio openings.

Once the barrier layer is formed, the opening can be lined with a thin conformal adhesion layer adapted to promote adhesion between the barrier layer and a subsequently applied copper-plating seed layer. For example, an approximately 3-10 nm thick conformal layer of tantalum, ruthenium, a tantalum ruthenium alloy or any other suitable metal or metal alloy that will promote adhesion between the barrier layer and the copper-plating seed layer can be deposited. Again, depending upon the aspect ratio of the opening this thin conformal adhesion layer can be deposited by physical vapor deposition (PVD), chemical vapor deposition (CVD) and atomic layer deposition (ALD).

Next, the opening can be lined with a thin conformal copper-plating seed layer adapted to selectively promote electroplating of copper or the copper alloy that will subsequently be electroplated into the opening. For example, an approximately 5-40 nm thick conformal layer of copper, a copper alloy, iridium, an iridium alloy, ruthenium, a ruthenium alloy (e.g., a tantalum ruthenium alloy), or any other suitable nobel metal or nobel metal alloy layer, having a low copper-plating over-potential, can be deposited. Again, depending upon the aspect ratio of the opening, this thin copper-plating seed layer can be deposited by physical vapor deposition (PVD), chemical vapor deposition (CVD) and atomic layer deposition (ALD).

Once the opening is lined with the thin copper-plating seed layer, a thin conformal protective layer that selectively prevents electroplating of copper or the copper alloy can be formed on the copper-plating seed layer. Specifically, a thin conformal protective layer adapted to selectively prevent electroplating of copper or a copper alloy can be deposited onto the copper-plating seed layer such that it lines the opening. For example, a metal (e.g., tantalum, tungsten, titanium, chromium, etc.), a metal alloy or a dielectric (e.g., an oxide or a nitride), having a copper-plating over-potential sufficient to selectively prevent electroplating of the copper or the copper alloy, can be pre-selected and deposited in a thin conformal layer (e.g., an approximately 1.5-10 nm thick conformal layer) over the copper-plating seed layer. Again, depending upon the aspect ratio of the opening, this thin conformal protective layer can be deposited by physical vapor deposition (PVD), chemical vapor deposition (CVD) and atomic layer deposition (ALD).

Then, the protective layer on the bottom surface of the opening is removed (e.g., by using a directional etch process) so as to expose the copper-plating seed layer at the bottom of the opening, while leaving covered the copper-plating seed layer on the opening sidewalls. For example, if the protective layer comprises a metal, such as tantalum, tungsten, titanium, or chromium, it can be removed from the bottom surface of the opening by using an argon (Ar) sputtering process.

Once the copper-plating seed layer at the bottom surface of the opening is exposed, an electroplating process is performed in order to fill the opening with an electroplated layer comprising copper or the copper alloy. This electroplating process can comprise using a copper-plating chemistry with additives to promote super-filling of the opening with the electroplated copper or copper alloy layer. During this electroplating process, the protective layer on sidewalls of the opening selectively prevents electroplating of copper or the copper alloy and the exposed portion of the copper-plating seed layer at the bottom surface of the opening promotes electroplating of copper or the copper alloy such that the electroplating process fills the opening with the electroplated copper or copper alloy layer from the bottom surface up. Since the opening is filled with copper or the copper alloy from the bottom surface up (i.e., not from the sidewalls inward), no "pinch-off" can occur and the electroplated copper or copper alloy layer is formed without the formation seams and voids (i.e., is formed free from seams and voids).

These and other aspects of the embodiments of the invention will be better appreciated and understood when considered in conjunction with the following description and the accompanying drawings. It should be understood, however, that the following descriptions, while indicating embodiments of the invention and numerous specific details thereof, are given by way of illustration and not of limitation. Many changes and modifications may be made within the scope of these embodiments without departing from the spirit thereof, and the embodiments of the invention include all such changes modifications.

BRIEF DESCRIPTION OF THE DRAWINGS

The embodiments of the invention will be better understood from the following detailed description with reference to the drawings, in which.

DETAILED DESCRIPTION OF EMBODIMENTS

Figure 1:
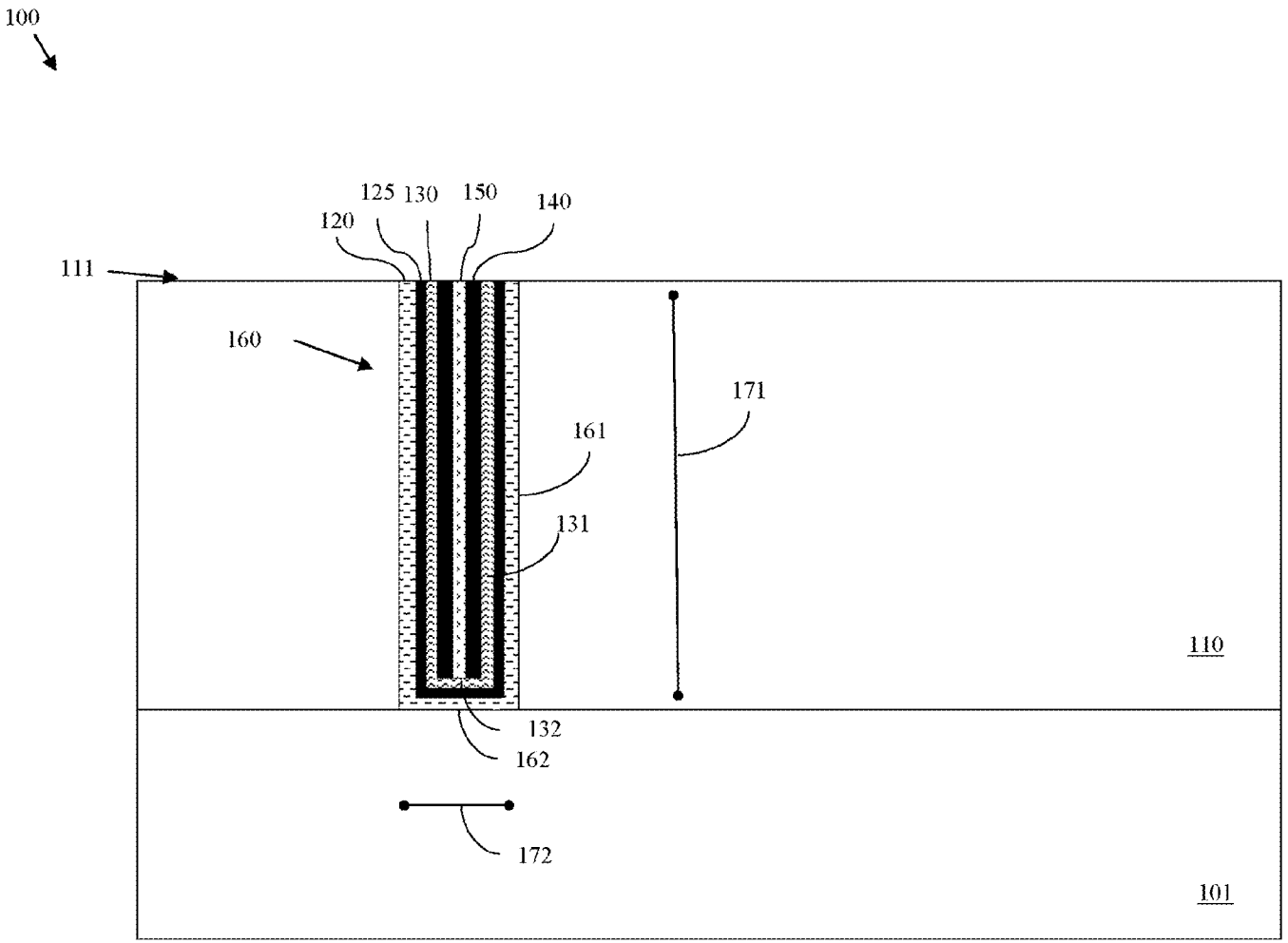
FIG. 1 is a cross-section diagram illustrating a high aspect ratio electroplated metal structure of the present invention.
Figure 2:
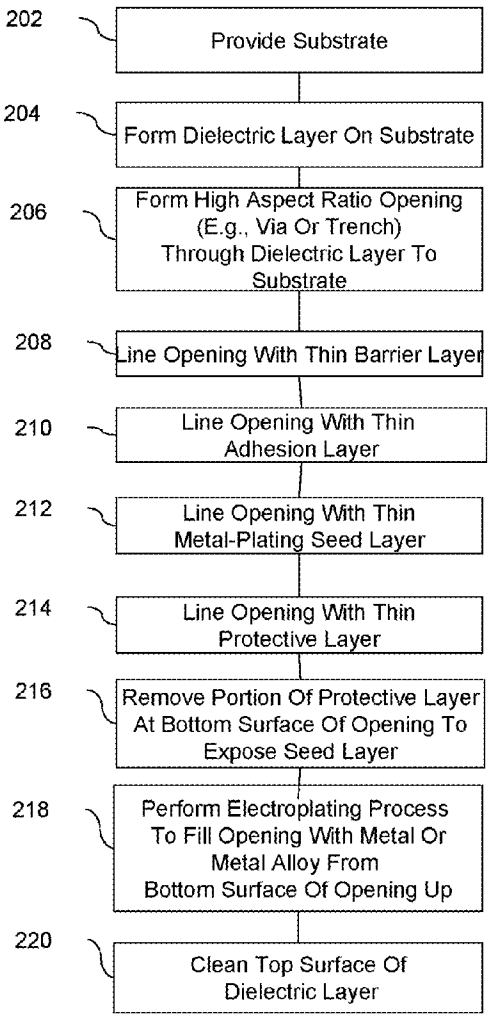
FIG. 2 is a flow diagram illustrating an embodiment of the method of the invention.

The embodiments of the invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the invention. The examples used herein are intended merely to facilitate an understanding of ways in which the embodiments of the invention may be practiced and to further enable those of skill in the art to practice the embodiments of the invention. Accordingly, the examples should not be construed as limiting the scope of the embodiments of the invention.

As discussed above, a semiconductor device, such as a field effect transistor (FET), is often formed with both back end of the line (BEOL) contacts to the gate and source/drain regions of the device to turn the device on/off and to allow current to flow through the device, respectively, and a middle of the line (MOL) contact to the body of the device between the source/drain regions to adjust threshold voltage (Vt). Traditionally, conductive metals, such as Tungsten (W) and Aluminum (Al) have been deposited (e.g., by chemical vapor deposition (CVD), sputtering, etc.) into patterned vias in order to form both MOL and BEOL contacts. Recently, because of its lower electrical resistivity copper and copper alloys, which require plating, have become the preferred metal for filling BEOL contacts and have also become the subject of new development and research for filling MOL contacts.

Unfortunately, as circuit densities are increased, the aspect ratios for both MOL and BEOL contacts has increased and adequately plating such high aspect ratio contacts has proven difficult. Specifically, as circuit densities increase and device sizes are scaled, the width of both MOL and BEOL contacts is decreased; however, the thickness of the dielectric layers in which these contacts are formed has remained the same. Consequently, increased circuit densities have resulted in high aspect ratio contacts (i.e., contacts with high height to width ratios). For example, circuit designers currently require MOL and BEOL contacts with aspect ratios that are greater than 6:1 and oftentimes greater than 10:1. When conventional plating techniques are used to fill these high aspect ratio vias, seams and voids develop within the contact structure and these seams and voids inevitably affect contact performance. Several copper and copper alloy plating techniques have been developed that use plating additives to promote the super-filling of vias in an attempt to avoid the formation of seams and voids (e.g., as illustrated in U.S. Pat. No. 6,709,562 of Andricacos et al. issued on Mar. 23, 2004 and incorporated herein in its entirety by reference). However, with the ever-increasing aspect ratios plating additives alone are not sufficient to eliminate all seams and voids in the contact structure. Specifically, even in the presents of plating additives that promote super-filling of vias, material that is plated on the upper sidewalls of a high aspect ratio via can merge (i.e., pinch-off) before the via is filled, leaving seams and/or voids below. Therefore, there is a need in the art for an improved high aspect ratio electroplated metal structure, such as a copper or copper alloy interconnect or contact, and method of forming such an electroplated metal structure.

In view of the foregoing, disclosed herein are embodiments of an improved high aspect ratio electroplated metal structure (e.g., a copper or copper alloy interconnect, such as a back end of the line (BEOL) or middle of the line (MOL) contact) in which the electroplated metal fill material is free from seams and/or voids. Also, disclosed are embodiments of a method of forming such an electroplated metal structure by lining a high aspect ratio opening (e.g., a high aspect ratio via or trench) with a metal-plating seed layer and, then, forming a protective layer over the portion of the metal-plating seed layer adjacent to the opening sidewalls so that subsequent electroplating occurs only from the bottom surface of the opening up.

Referring to FIG. 1, a general structure embodiment of the present invention comprises an electroplated metal integrated circuit feature 100 (e.g., an electroplated metal back end of the line (BEOL) or middle of the line (MOL) interconnect, such as a BEOL or MOL contact). This metal feature can comprise a substrate 101 and a dielectric layer 110 adjacent the substrate 101.

An opening 160 (e.g., a via, a trench, etc.), having sidewalls 161 and a bottom surface 162, can extend through the dielectric layer 110 to the substrate 101 in order to contact a feature of a semiconductor device formed in the substrate 101 (e.g., the gate, source/drain or body of a field effect transistor). The single-tier opening shown in FIG. 1 is provided for illustrated purposes only and is not intended to be limiting in that a multi-tier opening is also anticipated. More specifically, the structure 100 of the present invention can comprise either a single-tiered opening for a single damascene interconnect structure or a multi-tiered opening for a dual damascene interconnect structure. This opening 160 can further have a high aspect ratio. That is, the aspect ratio of the opening 160 can be greater than approximately 6:1 (i.e., the height 171 of the opening 160, which is equal to the thickness of the dielectric layer 110, can be greater than approximately 6 times the width 162).

A metal-plating seed layer 130 can line the opening 160 and an electroplated layer 150 comprising a metal or a metal alloy can fill the opening 160. The metal-plating seed layer 130 can be adapted to (i.e., pre-selected to or configured to) selectively promote electroplating of the metal or metal alloy.

It should be noted that an optional barrier layer 120 can line the opening 160 between the dielectric layer 110 and the metal-plating seed layer 130 to prohibit diffusion of the metal outside the opening 160 (i.e., to prevent metal out-diffusion). Additionally, an optional adhesion layer 125 can line the opening 160 between the optional barrier layer 120 and the metal-plating seed layer 130 in order to promote adhesion of the metal-plating seed layer 130 to the optional barrier layer 120.

Another aspect of this electroplated metal feature 100 is a protective layer 140 that is positioned over the portion of the metal-plating seed layer 130 adjacent to the opening sidewalls 161 so that the metal or metal alloy is prevented from being electroplated onto the opening sidewalls 161 and is only electroplated from the bottom surface 162 of the opening up. Electroplating only from the bottom surface 162 up avoids the prior art "pinch-off" problem (i.e., avoids materials plated on the upper sidewalls of the opening from merging and leaving seams and/or voids below).

Specifically, the metal-plating seed layer 130 can line the opening 160 such that it comprises a first portion 131 adjacent to the sidewalls 161 of the opening 160 and a second portion 132 adjacent to the bottom surface 162 of the opening 160. This metal-plating seed layer 130 can be adapted to (i.e., pre-selected to or configured to) selectively promote electroplating of the metal or metal alloy.

The protective layer 140 can be positioned adjacent to the first portion 131 of the metal-plating seed layer 130, but not the second portion 132. That is, the protective layer 140 can cover the first portion 131 of the metal-plating seed layer 130 on the opening sidewalls 161, leaving the second portion 132 of the metal-plating seed layer 130 on the bottom surface 162 of the opening 160 exposed. This protective layer 140 can be adapted to (i.e., pre-selected to or configured to) selectively prevent electroplating of the metal or metal alloy. For example, the protective layer 140 can comprise an additional metal layer or an additional dielectric layer that has a metal-plating over-potential that is sufficient to selectively prevent electroplating of the metal or metal alloy. Those skilled in the art will recognize that over-potential refers to energy required to force an electrode reaction to proceed. For example, in an electroplating process the over-potential refers to the energy required to force a metal to plate onto the cathode. A high over-potential limits plating, whereas a low over-potential enhances plating.

The electroplated metal or metal alloy layer 150 can be positioned adjacent to the protective layer 140 at the opening sidewalls as well as adjacent to the second portion 132 of the metal-plating seed layer 130 at the bottom surface 162 of the opening 160 such that it fills the opening 160. However, due to the protective layer 140, the metal or metal alloy is only electroplated onto the exposed portion 132 of the metal-plating seed layer 130 at the bottom surface 162 of the opening 160. Since the opening 160 is filled with the electroplated metal or metal alloy from the bottom surface 132 up (i.e., not from the sidewalls 131 inward), no "pinch-off" occurs and the electroplated metal or metal alloy layer 150 is free from seams and voids.

Also referring to FIG. 1, a particular structure embodiment of the present invention comprises a copper or copper alloy plated-interconnect 100 (e.g., a copper or copper alloy-plated BEOL or MOL contact). This interconnect 100 can comprise a substrate 101 and a dielectric layer 110 adjacent the substrate 101.

An opening 160 (e.g., a via, a trench, etc.), having sidewalls 161 and a bottom surface 162, can extend through the dielectric layer 110 to the substrate 101 in order to contact a feature of a semiconductor device formed in the substrate 101 (e.g., the gate, source/drain or body of a field effect transistor). The single-tier opening shown in FIG. 1 is provided for illustrated purposes only and is not intended to be limiting in that a multi-tier opening is also anticipated. More specifically, the copper or copper alloy-plated interconnect 100 of the present invention can comprise either a single-tiered opening for a single damascene interconnect structure or a multi-tiered opening for a dual damascene interconnect structure. This opening 160 can have a high aspect ratio. That is, the aspect ratio of the opening 160 can be greater than approximately 6:1 (i.e., the height 171 of the opening 160, which is equal to the thickness of the dielectric layer 110, can be greater than approximately 6 times the width 172 of the opening 160).

A copper-plating seed layer 130 can line the opening 160 and an electroplated layer 150 comprising a copper or copper alloy can fill the opening. The copper-plating seed layer 130 can be adapted to (i.e., pre-selected to or configured to) selectively promote electroplating of copper or the copper alloy. For example, the copper-plating seed layer 130 can comprise an approximately 5-40 nm thick conformal layer of copper, a copper alloy, iridium, an iridium alloy, ruthenium, a ruthenium alloy (e.g., a tantalum ruthenium alloy) or any other suitable nobel metal or nobel metal alloy which would selectively promote electroplating of copper or the copper alloy.

It should be noted that a barrier layer 120 can line the opening 160 between the dielectric layer 110 and the copper-plating seed layer 130 to prohibit diffusion of copper outside the opening 160 (i.e., to prohibit copper outdiffusion). For example, the barrier layer 120 can comprise an approximately 3-10 nm thick conformal layer of titanium, titanium nitride, titanium silicon nitride, tantalum, tantalum nitride, tantalum silicon nitride, tungsten, tungsten nitride, tungsten silicon nitride or any other suitable metal or metal alloy adapted to (i.e., pre-selected to or configured to) prevent copper outdiffusion. Additionally, an optional adhesion layer 125 can line the opening 160 between the barrier layer 120 and the copper-plating seed layer 130 in order to promote adhesion of the copper-plating seed layer 130 to the barrier layer 120. For example, the adhesion layer 125 can comprise an approximately 3-10 nm thick conformal layer of tantalum, ruthenium, a tantalum ruthenium alloy or any other suitable metal or metal alloy adapted to (i.e., pre-selected to or configured to) promote adhesion of the copper-plating seed layer 130 to the barrier layer 120.

Another aspect of this copper or copper alloy-plated interconnect 100 is a protective layer 140 that is positioned over the portion 131 of the copper-plating seed layer 130 adjacent to the opening sidewalls 161 so that copper or the copper alloy is prevented from being electroplated onto the opening sidewalls 161 and is only electroplated from the bottom surface 162 of the opening up. Electroplating only from the bottom surface 162 up avoids the prior art "pinch-off" problem (i.e., avoids materials plated on the upper sidewalls of the opening from merging and leaving seams and/or voids below).

Specifically, the copper-plating seed layer 130 can line the opening 160 such that it comprises a first portion 131 adjacent to the sidewalls 161 of the opening 160 and a second portion 132 adjacent to the bottom surface 162 of the opening 160. As discussed above, this copper-plating seed layer 130 can be adapted to (i.e., pre-selected to or configured to) selectively promote electroplating of copper or the copper alloy.

The protective layer 140 can be positioned adjacent to the first portion 131 of the copper-plating seed layer 130, but not the second portion 132. That is, the protective layer 130 can cover the first portion 131 of the copper-plating seed layer 130 on the opening sidewalls 161, leaving the second portion 132 of the copper-plating seed layer 130 on the bottom surface 162 of the opening 160 exposed. This protective layer 140 can be adapted to (i.e., pre-selected to or configured to) selectively prevent electroplating of copper or the copper alloy. For example, the protective layer 140 can comprise an additional metal layer or an additional dielectric layer that has a copper-plating over-potential sufficient to selectively prevent electroplating of copper or the copper alloy (i.e., the additional metal or dielectric layer has a high copper-plating over-potential). For example, the protective layer 140 can comprise an approximately 1.5-10 nm thick conformal protective layer of tantalum, tungsten, titanium, chromium or any other suitable metal or metal alloy with a high copper-plating over-potential. Alternatively, the protective layer 140 comprises an approximately 1.5-10 nm thick conformal protective layer of a dielectric material (e.g., an oxide or a nitride) with a high copper-plating over-potential. Again, those skilled in the art will recognize that over-potential refers to energy required to force an electrode reaction to proceed. For example, in a copper or copper alloy electroplating process the copper-plating over-potential refers to the energy required to force the copper or copper alloy to plate onto the cathode. A high over-potential limits plating, whereas a low over-potential enhances plating.

The electroplated copper or copper alloy layer 150 can be positioned adjacent to the protective layer 140 at the opening sidewalls 161 as well as adjacent to the second portion 132 of the copper-plating seed layer 130 at the bottom surface 162 of the opening 160 such that it fills the opening 160. However, due to the protective layer 140, the copper or copper alloy is only electroplated onto the exposed portion 132 of the copper-plating seed layer 130 at the bottom surface 162 of the opening 160. Since the opening 160 is filled with the electroplated copper or copper alloy from the bottom surface 162 up (i.e., not from the sidewalls 162 inward), no "pinch-off" occurs and the electroplated copper or copper alloy layer 150 is free from seams and voids.

Also, disclosed are method embodiments for forming the general and specific structure embodiments, described above. Specifically, a method embodiment for forming the above-described electroplated metal integrated circuit feature comprises first providing a substrate 101 and forming a dielectric layer, having a predetermined thickness 171, on the substrate 101 (202-204, see FIG. 3). Next, a high aspect ratio opening 160 (i.e., a high aspect ratio via, a high aspect ratio trench, etc.) is patterned and etched through the dielectric layer 110 in order to contact a feature of a semiconductor device formed in the substrate 101 (e.g., the gate, source/drain or body of a field effect transistor) (206, see FIG. 4). Specifically, the opening is etched such that the aspect ratio of the opening 160 is greater than approximately 6:1 (i.e., such that the height 171 of the opening 160, which is equal to the thickness of the dielectric layer, is greater than approximately 6 times the width 172 of the opening 160). The process of forming the opening can be accomplished using conventional lithographic techniques. It should be noted that the single-tier opening shown in FIG. 4 is provided for illustrated purposes only and is not intended to be limiting in that a multi-tier opening is also anticipated. More specifically, the method of the present invention can comprise forming either a single-tiered opening for a single damascene interconnect structure or a multi-tiered opening for a dual damascene interconnect structure.

Figure 5:
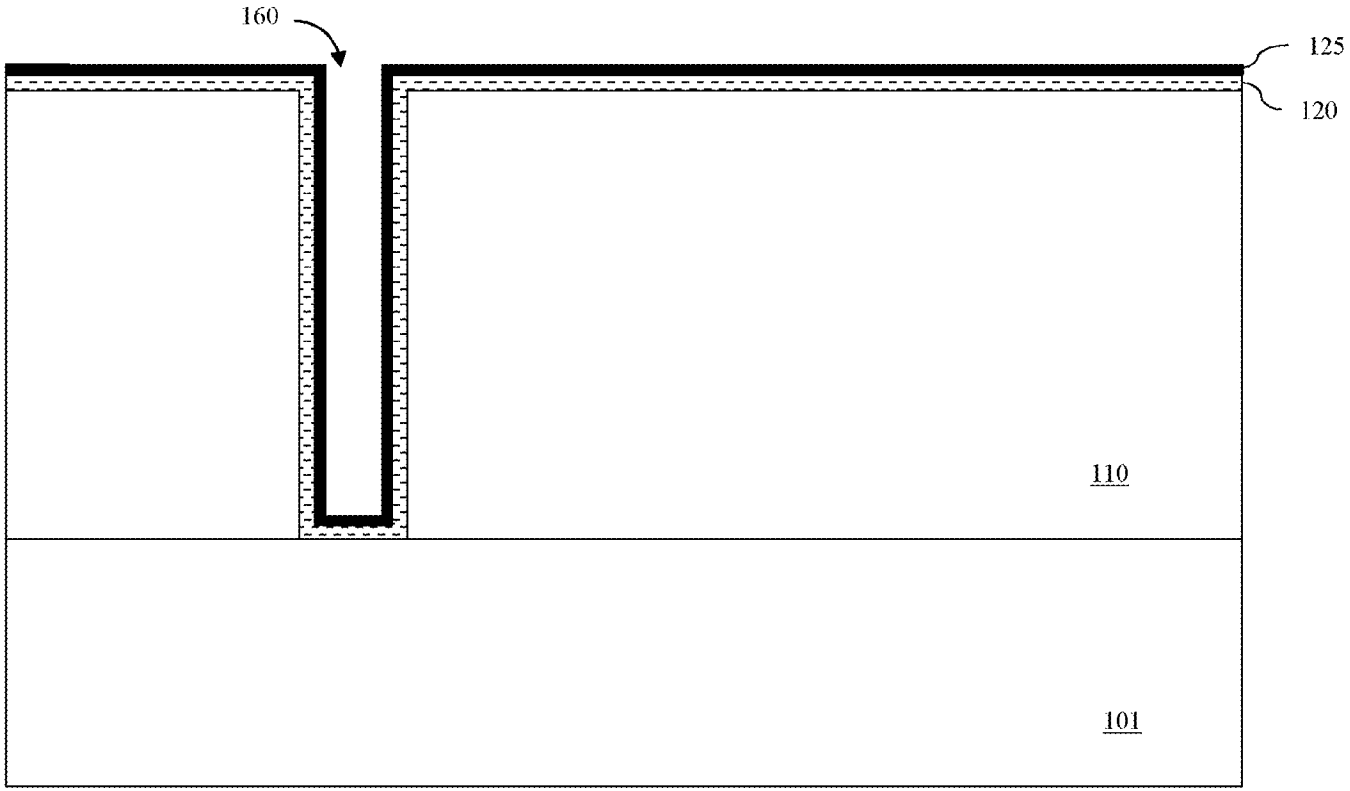
FIG. 5 is a cross-section of a partially completed high aspect ratio electroplated metal structure.

After the opening 160 is etched, it can be lined with an optional barrier layer 120 as well as an adhesion layer 125 (208-210, see FIG. 5). Next, the opening 160 can be lined with a metal-plating seed layer 130 adapted to (i.e., pre-selected to or configured to) selectively promote electroplating of a pre-selected metal or metal alloy that will subsequently be electroplated onto the metal-plating seed layer 130 in order to fill the opening 160 (212, see FIG. 6).

Figure 7:
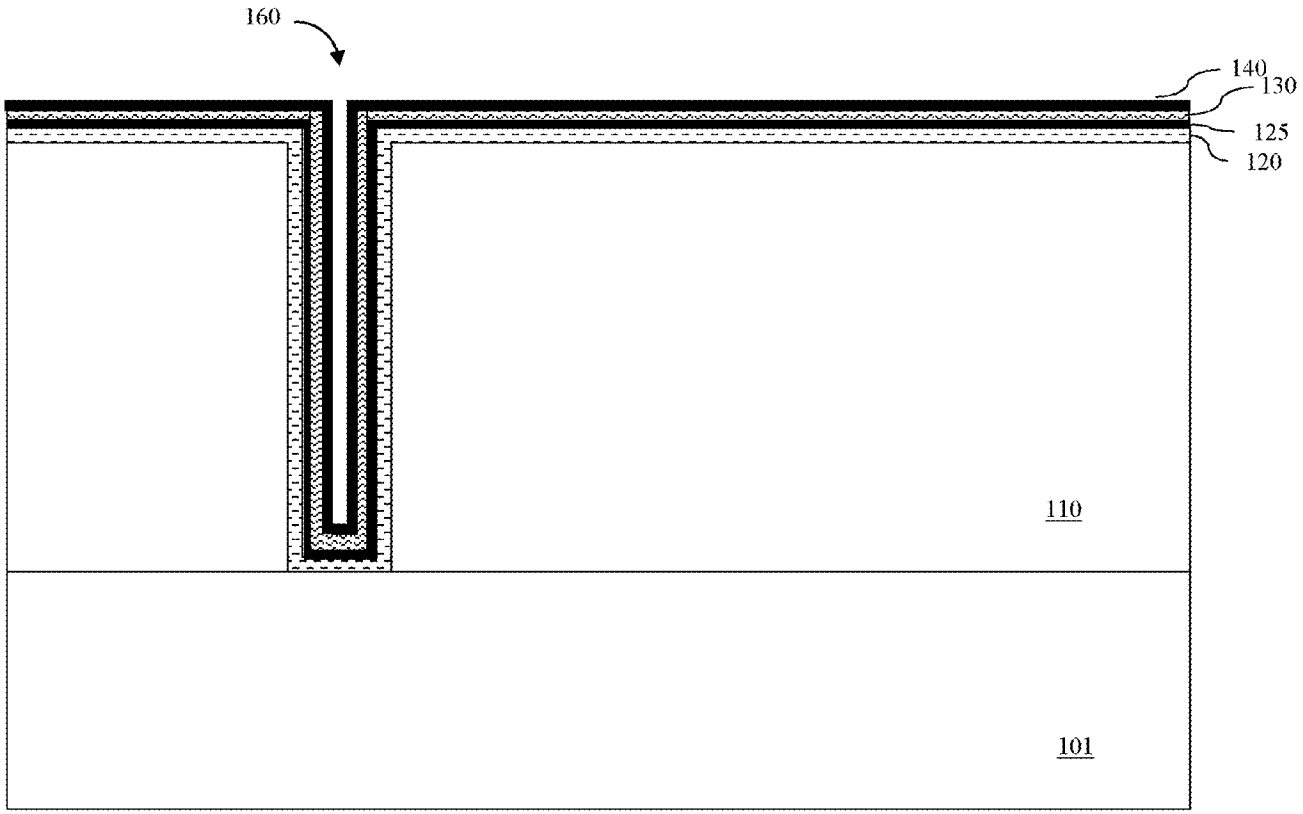
FIG. 7 is a cross-section of a partially completed high aspect ratio electroplated metal structure.

Once the metal-plating seed layer 130 is formed, a thin conformal protective layer 140 is formed on the metal-plating seed layer 1130 (214, see FIG. 7). Specifically, a thin conformal protective layer adapted to selectively prevent electroplating of the pre-selected metal or metal alloy can be deposited over the metal-plating seed layer 130 such that it lines the opening 160. For example, an additional metal or dielectric material 140 having a metal-plating over-potential sufficient to selectively prevent electroplating of the pre-selected metal or the metal alloy that will subsequently fill the opening 160 can be pre-selected. This additional metal or dielectric material 140 can then be deposited such that it is positioned adjacent the metal-plating seed layer 130 and lines the opening 160. Then, the protective layer 140 on the bottom surface 162 of the opening 160 is removed (e.g., by using a directional etch process) so as to expose only the portion 132 of the metal-plating seed layer at the bottom 162 of the opening 160, leaving covered the portion 131 of the metal-plating seed layer 130 on the opening sidewalls 161 (216, see FIG. 8).

It should be noted that depending upon the processes used to deposit and then directionally etch the protective layer 140 either all (as illustrated) or only a portion of the layer 140 will be etched away from above the dielectric layer 110. For example, the protective layer deposition process may form a thicker protective layer 140 in the field outside the opening 160 than on the bottom surface 162 of the opening 160. Thus, if the portion of the protective layer 140 is removed from the bottom surface 162 of the opening 160 using a directional etch process, some of the protective layer 140 will still remain in the field above the dielectric layer 110 outside the opening 160.

Figure 9:
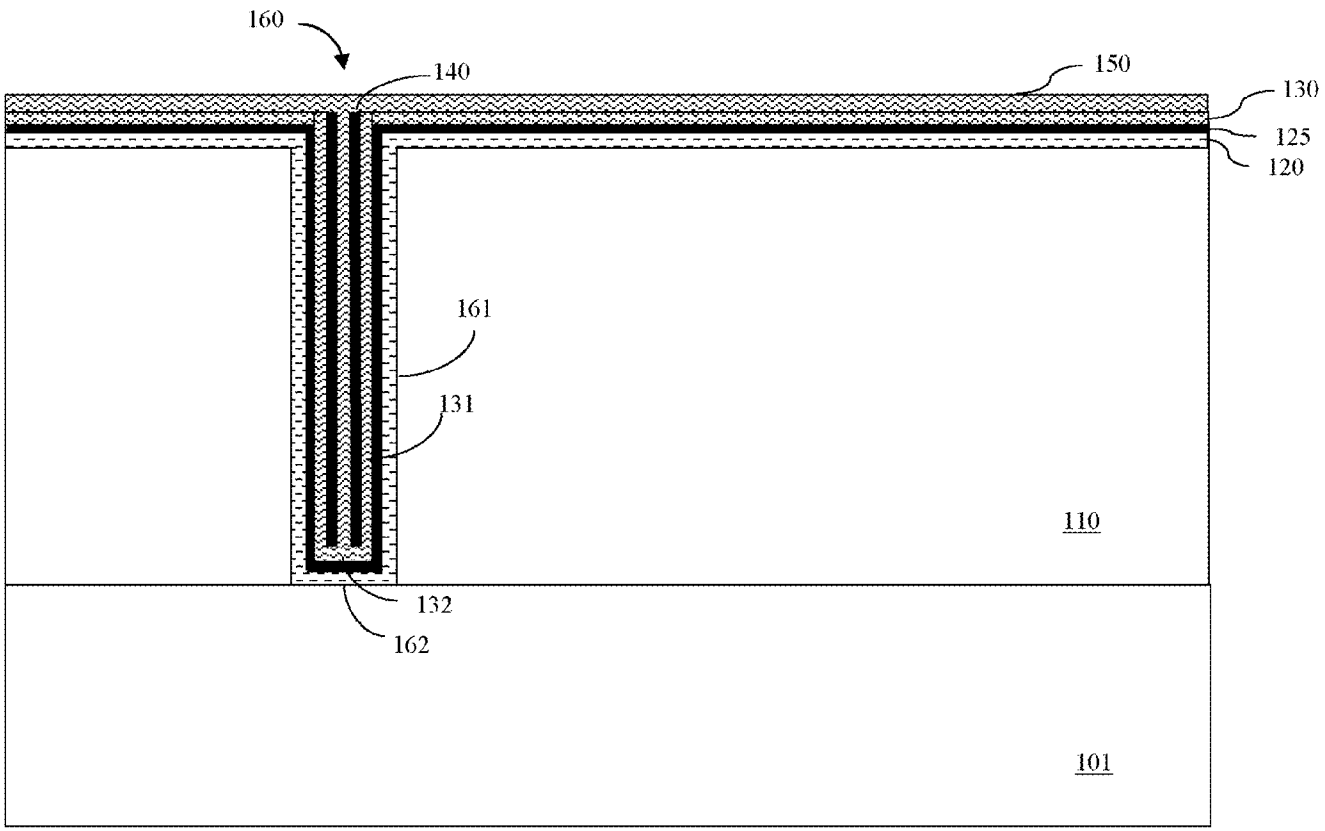
FIG. 9 is a cross-section of a partially completed high aspect ratio electroplated metal structure.
Figure 10:
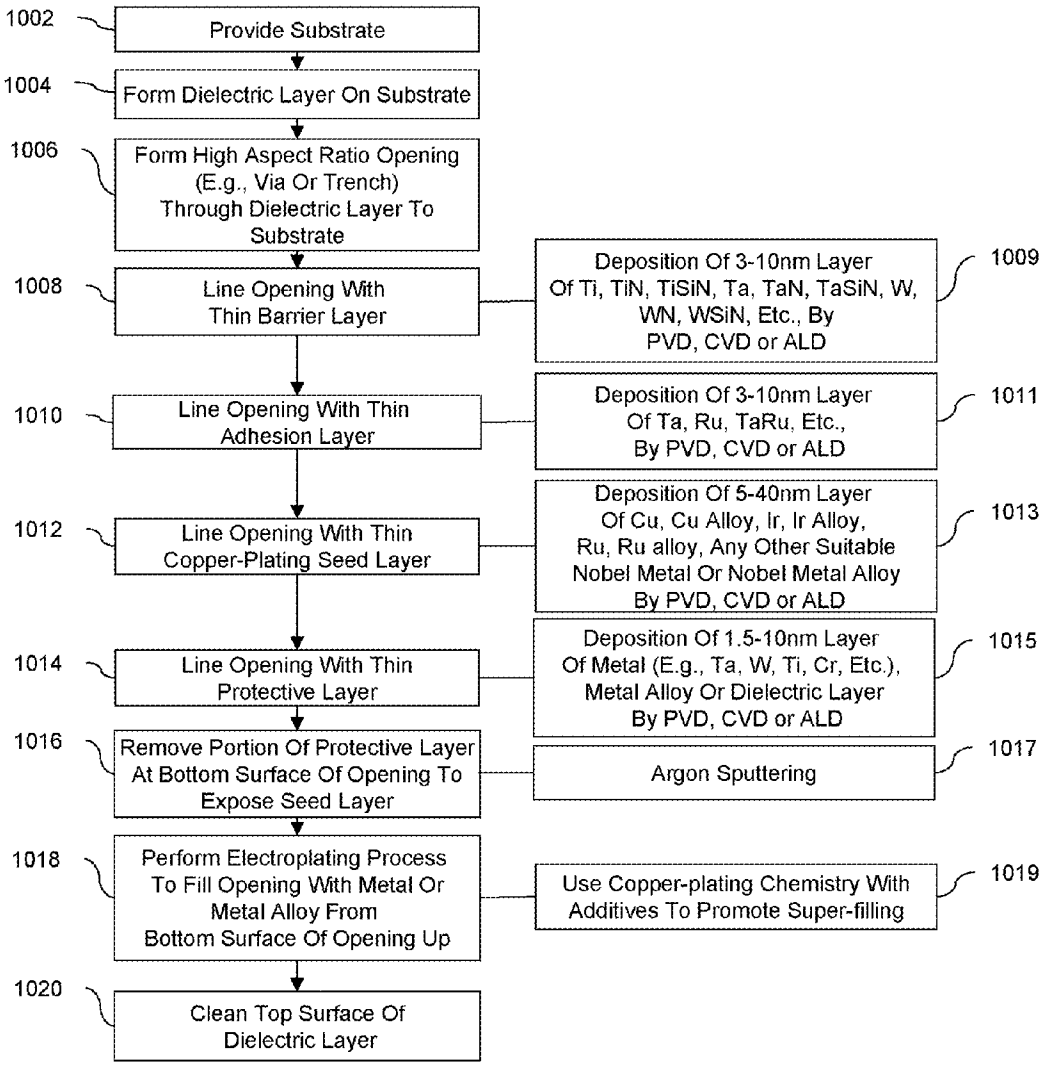
FIG. 10 is a flow diagram illustrating another embodiment of the method of the invention.

Once the portion 132 of the metal-plating seed layer 130 at the bottom surface 162 of the opening 160 is exposed, an electroplating process is performed in order to fill the opening with an electroplated layer 150 comprising the pre-selected metal or metal alloy (218, see FIG. 9). During this electroplating process, the protective layer 140 on sidewalls 161 of the opening 160 selectively prevents electroplating of the metal or metal alloy and the exposed 132 portion of the metal-plating seed layer 130 at the bottom surface 162 of the opening 160 selectively promotes electroplating of the metal or metal alloy such that the electroplating process fills the opening 160 with the electroplated layer 150 from the bottom surface up. Since the opening 160 is filled with the electroplated metal or metal alloy from the bottom surface 162 up (i.e., not from the sidewalls 161 inward), no "pinch-off" can occur and the electroplated metal or metal alloy layer 150 is formed without the formation of seams and voids (i.e., it is formed free from seams and voids).

Figure 8:
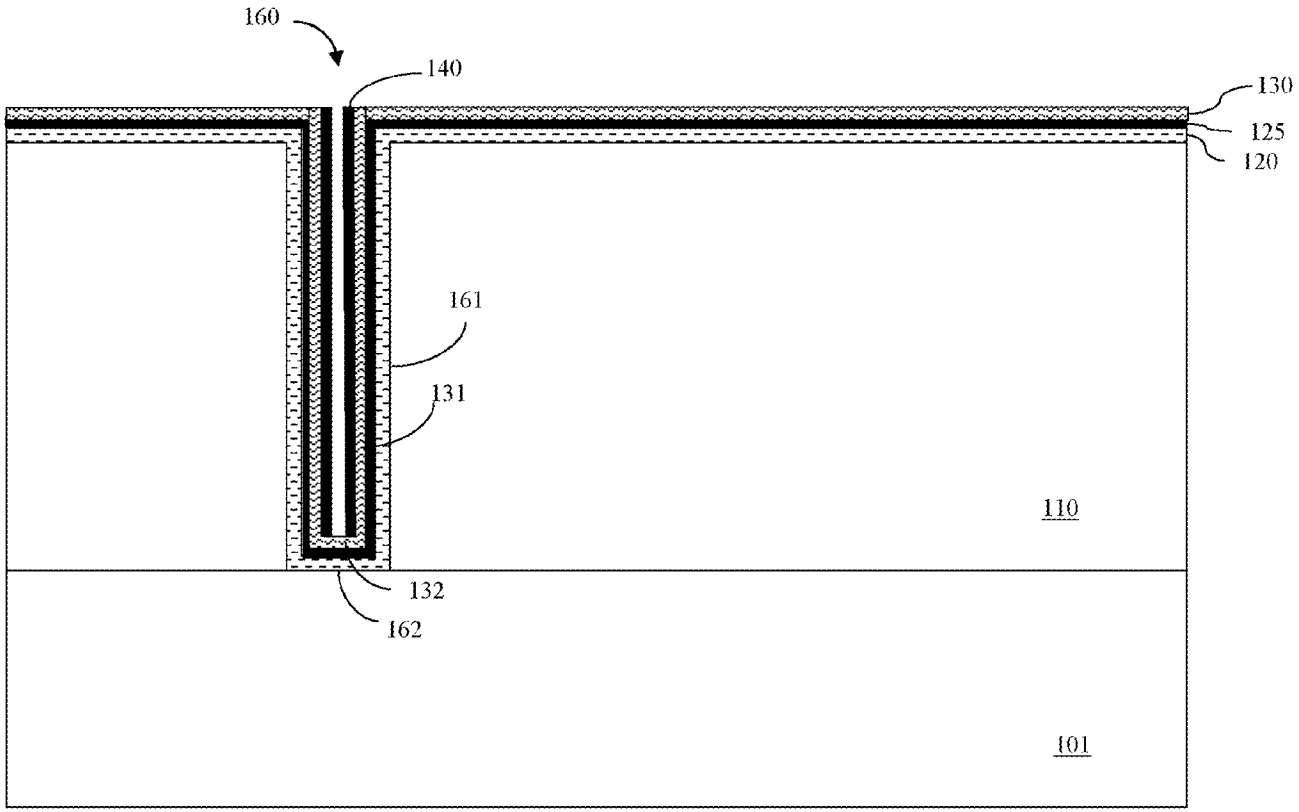
FIG. 8 is a cross-section of a partially completed high aspect ratio electroplated metal structure.

It should be noted that if, as illustrated in FIG. 8, all of the protective layer 140 is removed from the metal-plating seed layer 130 above-the dielectric layer 110, then the electroplated layer 150 will also be formed in the field outside the opening 160, as illustrated in FIG. 9. However, if, as discussed above, some of the protective layer 140 still remains in the field outside the opening 160 (i.e., above the dielectric layer 110), then the electroplated layer 150 will only fill the opening 160.

Once the opening 160 is metal-plated, the top surface 111 of the dielectric layer will be cleaned, for example, using conventional chemical mechanical polishing (CMP) techniques, to remove the barrier layer 120, adhesion layer 125, metal-plating seed layer 130, protective layer 140 and/electroplated layer 150, as needed (220, see resulting structure 100 of FIG. 1).

Figure 3:
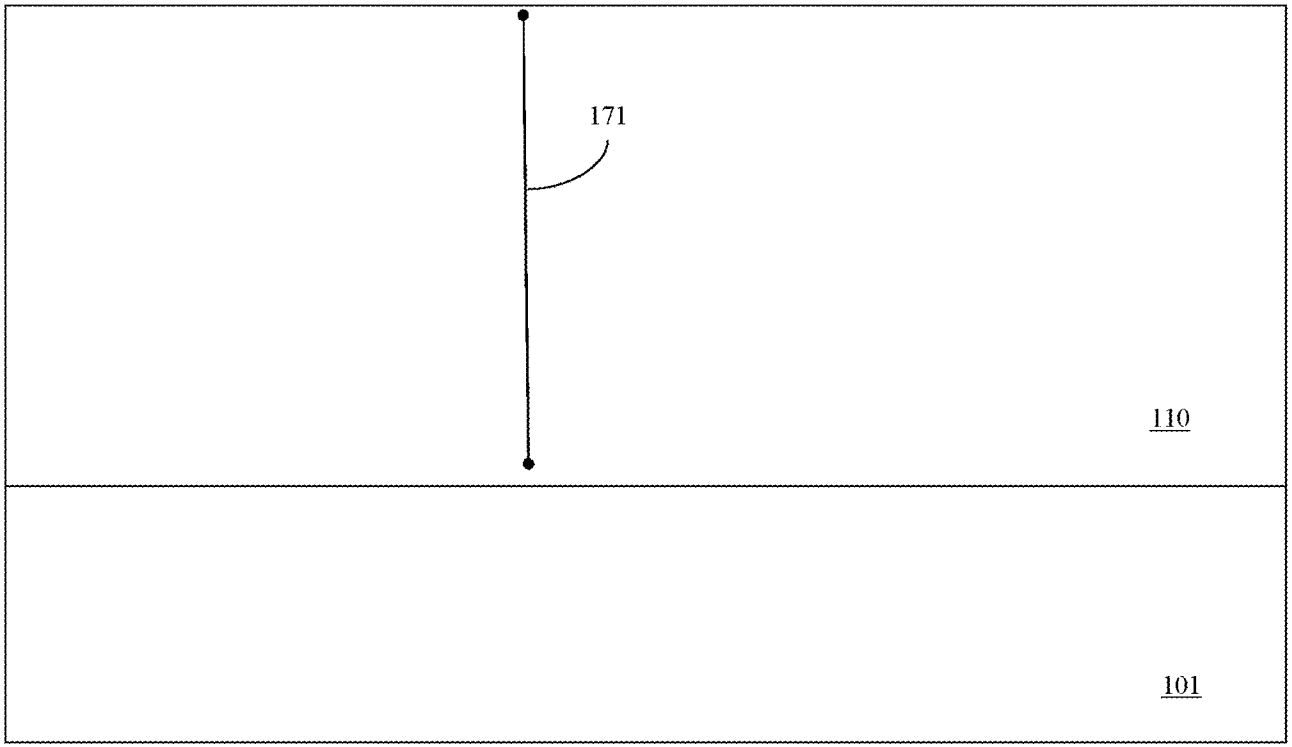
FIG. 3 is a cross-section of a partially completed high aspect ratio electroplated metal structure.
Figure 4:
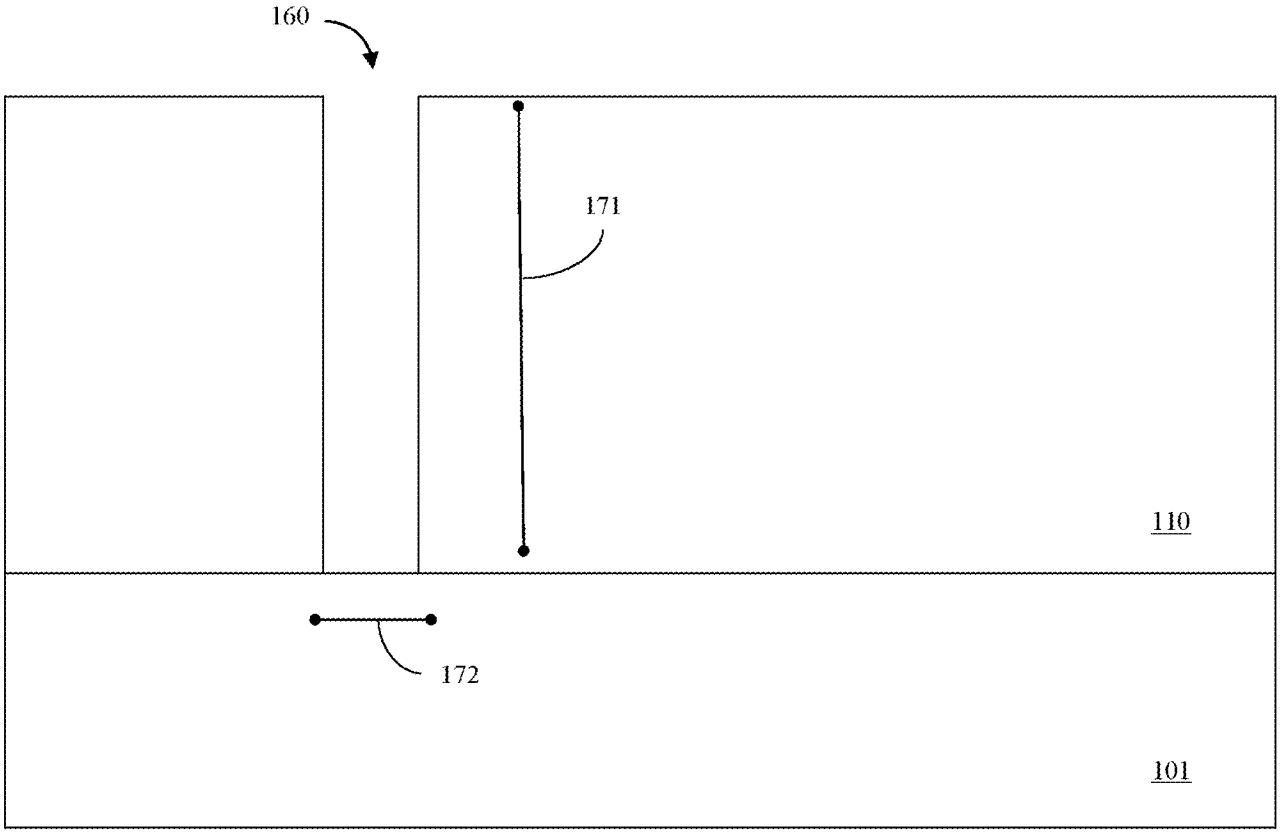
FIG. 4 is a cross-section of a partially completed high aspect ratio electroplated metal structure.

A method embodiment for forming the above-described copper or copper alloy-plated interconnect 100 similarly comprises first providing a substrate 101 and forming a dielectric layer 110, having a predetermined thickness 171, on the substrate 101 (1002-1004, see FIG. 3). Next, a high aspect ratio opening 160 (i.e., a high aspect ratio via, a high aspect ratio trench, etc.) is patterned and etched through the dielectric layer 110 in order to contact a feature of a semiconductor device formed in the substrate 101 (e.g., the gate, source/drain or body of a field effect transistor) (1006, see FIG. 4). Specifically, the opening 160 is etched such that the aspect ratio of the opening 160 is greater than approximately 6:1 (i.e., such that the height 171 of the opening, which is equal to the thickness of the dielectric layer 110, is greater than approximately 6 times the width 172 of the opening). The process of forming the opening can be accomplished using conventional lithographic techniques. It should be noted that the single-tier opening shown in FIG. 4 is provided for illustrated purposes only and is not intended to be limiting in that a multi-tier opening is also anticipated. More specifically, the method of the present invention can comprise forming either a single-tiered opening for a single damascene interconnect structure or a multi-tiered opening for a dual damascene interconnect structure.

After the opening 160 is etched, it can be lined with a thin barrier layer 120 adapted to (i.e., pre-selected to or configured to) prevent copper out-diffusion (i.e., to prevent diffusion of copper from the opening) (1008, see FIG. 5). For example, an approximately 3-10 nm thick conformal layer of titanium, titanium nitride, titanium silicon nitride, tantalum, tantalum nitride, tantalum silicon nitride, tungsten, tungsten nitride, tungsten silicon nitride or any other metal or metal alloy sufficient to prevent copper out-diffusion can be deposited (1009). Depending upon the aspect ratio of the opening this thin barrier layer can be deposited by physical vapor deposition (PVD), chemical vapor deposition (CVD) and atomic layer deposition (ALD). Those skilled in the art will recognize that PVD deposition may be more suitable for relatively low aspect ratio openings, whereas ALD may be more suitable for relatively high aspect ratio openings.

Once the barrier layer 120 is formed, the opening 160 can be lined with a thin conformal adhesion layer 125 adapted to (i.e., pre-selected to or configured to) promote adhesion between the barrier layer 120 and a subsequently applied copper-plating seed layer 130 (1010, see FIG. 5). For example, an approximately 3-10 nm thick conformal layer of tantalum, ruthenium, a tantalum ruthenium alloy or any other suitable metal or metal alloy that will promote adhesion between the barrier layer 120 and the copper-plating seed layer 130 can be deposited (1011). Again, depending upon the aspect ratio of the opening this thin conformal adhesion layer can be deposited by physical vapor deposition (PVD), chemical vapor deposition (CVD) and atomic layer deposition (ALD).

Figure 6:
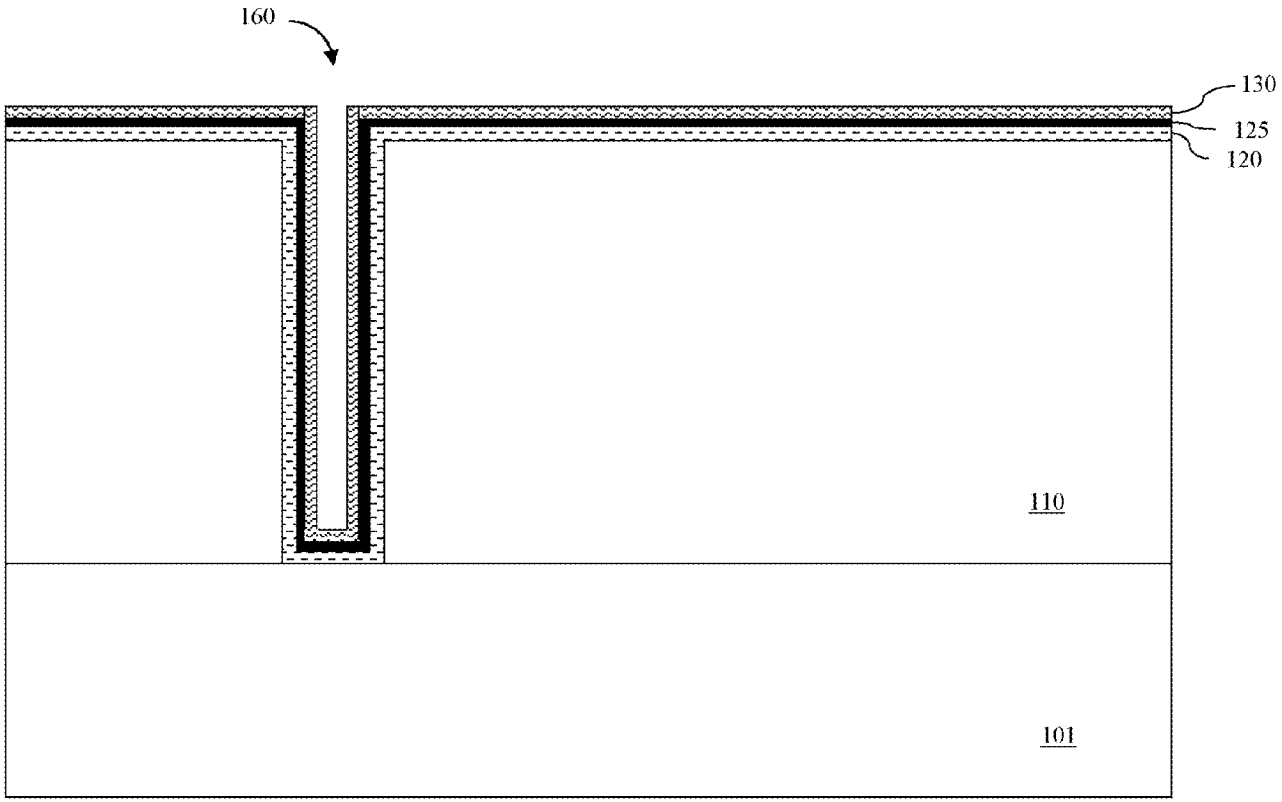
FIG. 6 is a cross-section of a partially completed high aspect ratio electroplated metal structure.

Next, the opening 160 can be lined with a thin conformal copper-plating seed layer 130 adapted to (i.e., pre-selected to or configured to) selectively promote electroplating of copper or the copper alloy that will subsequently be electroplated into the opening 160 (1012, see FIG. 6). For example, an approximately 5-40 nm thick conformal layer 130 of copper, a copper alloy (e.g., with indium or magnesium), iridium, an iridium alloy, ruthenium, a ruthenium alloy (e.g., a tantalum ruthenium alloy) or any other suitable nobel metal or nobel metal alloy layer, having a low copper-plating over-potential, can be deposited (1013). Again, depending upon the aspect ratio of the opening 160, this thin copper-plating seed layer can be deposited by physical vapor deposition (PVD), chemical vapor deposition (CVD) and atomic layer deposition (ALD).

Once the opening 160 is lined with the thin copper-plating seed layer 130, a thin conformal protective layer 140 can be formed on the copper-plating seed layer 130 (1014, see FIG. 7). Specifically, a thin (e.g., approximately 1.5-10 nm thick) conformal protective layer 140 adapted to selectively prevent electroplating of copper or the copper alloy can be deposited over the copper-plating seed layer 130 such that it lines the opening 160. For example, a metal material (e.g., tantalum, tungsten, titanium, chromium, etc.), a metal alloy material or a dielectric material (e.g., an oxide or a nitride), having a copper-plating over-potential sufficient to selectively prevent electroplating of the copper or the copper alloy, can be pre-selected and deposited over the copper-plating seed layer 130 such that it lines the opening 160 (1015). Again, depending upon the aspect ratio of the opening, this thin conformal protective layer can be deposited by physical vapor deposition (PVD), chemical vapor deposition (CVD) and atomic layer deposition (ALD).

Then, the protective layer 140 on the bottom surface 162 of the opening 160 is removed (e.g., by using a directional etch process) so as to expose only the portion 132 of the copper-plating seed layer 130 at the bottom of the opening 160, while leaving covered the portion 131 of the copper-plating seed layer 130 on the opening sidewalls 161 (1016, see FIG. 8). For example, if the protective layer 140 comprises a metal, such as tantalum, tungsten, titanium, or chromium, it can be removed from the bottom surface of the opening by using an argon sputtering process (1017).

It should be noted that depending upon the processes used to deposit and then directionally etch the protective layer 140 either all (as illustrated) or only a portion of the layer 140 will be etched away from above the dielectric layer 110. For example, the protective layer deposition process may form a thicker protective layer 140 in the field outside the opening 160 than on the bottom surface 162 of the opening 160. Thus, if the portion of the protective layer 140 is removed from the bottom surface 162 of the opening 160 using a directional etch process, some of the protective layer 140 will still remain in the field above the dielectric layer 110 outside the opening 160.

Once the copper-plating seed layer 130 at the bottom surface of the opening 160 is exposed, an electroplating process is performed in order to fill the opening 160 with an electroplated layer 150 comprising copper or the copper alloy (1018, see FIG. 9). This electroplating process can comprise using a copper-plating chemistry with additives to promote superfilling of the opening with the electroplated copper or copper alloy layer (e.g., as illustrated and described in U.S. Pat. No. 6,709,562 incorporated by reference above) (1019).

During this electroplating process, the protective layer 140 covering the portion 131 of the copper-plating seed layer 130 on the sidewalls 161 of the opening 160 selectively prevents electroplating of copper or the copper alloy and the exposed portion 132 of the copper-plating seed layer 130 at the bottom surface 162 of the opening 160 promotes electroplating of copper or the copper alloy such that the electroplating process fills the opening 160 with the electroplated copper or copper alloy layer 150 from the bottom surface up. Since the opening 160 is filled with copper or the copper alloy from the bottom surface 162 up (i.e., not from the sidewalls 161 inward), no "pinch-off" can occur and the electroplated copper or copper alloy layer 150 is formed without the formation seams and voids (i.e., is formed free from seams and voids).

It should be noted that if, as illustrated in FIG. 8, all of the protective layer 140 is removed from the metal-plating seed layer 130 above-the dielectric layer 110, then the electroplated layer 150 will also be formed in the field outside the opening 160, as illustrated in FIG. 9. However, if, as discussed above, some of the protective layer 140 still remains in the field outside the opening 160 (i.e., above the dielectric layer 110), then the electroplated layer 150 will only fill the opening 160.

Once the opening 160 is copper-plated, the top surface 111 of the dielectric layer will be cleaned, for example, using conventional chemical mechanical polishing (CMP) techniques, to remove the barrier layer 120, adhesion layer 125, metal-plating seed layer 130, protective layer 140 and/electroplated layer 150, as needed (1020, see resulting structure 100 of FIG. 1).

Therefore, disclosed above are embodiments of an improved high aspect ratio electroplated metal structure (e.g., a copper or copper alloy interconnect, such as a back end of the line (BEOL) or middle of the line (MOL) contact) in which the electroplated metal fill material is free from seams and/or voids. Also, disclosed are embodiments of a method of forming such an electroplated metal structure by lining a high aspect ratio opening (e.g., a high aspect ratio via or trench) with a metal-plating seed layer and, then, forming a protective layer over the portion of the metal-plating seed layer adjacent to the opening sidewalls so that subsequent electroplating occurs only from the bottom surface of the opening up.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the invention has been described in terms of embodiments, those skilled in the art will recognize that these embodiments can be practiced with modification within the spirit and scope of the appended claims.

What is claimed is:

1. A method of forming a metal structure comprising:

forming an opening through a dielectric layer to a substrate;

lining said opening with a metal-plating seed layer;

forming a protective layer on said metal-plating seed layer;

removing said protective layer from a bottom surface of said opening; and performing an electroplating process to fill said opening with an electroplated layer comprising one of a metal and a metal alloy, wherein said protective layer on sidewalls of said opening comprises a material pre-selected to have a metal-plating over-potential sufficient to selectively prevent electroplating of said one of said metal and said metal alloy, and an exposed portion of said metal-plating seed layer at said bottom surface of said opening promotes electroplating of said one of said metal and said metal alloy such that said electroplating process fills said opening with said electroplated layer from said bottom surface up.

2. The method of claim 1, further comprising:

providing said substrate;

forming said dielectric layer on said substrate such that said dielectric layer has a predetermined thickness; and patterning said opening in said dielectric layer such that an aspect ratio of said opening is greater than approximately 6:1.

3. A method of forming a metal structure comprising:

forming an opening through a dielectric layer to a substrate;

lining said opening with a metal-plating seed layer;

forming a protective layer on said metal-plating seed layer;

removing said protective layer from a bottom surface of said opening; and performing an electroplating process to fill said opening with an electroplated layer comprising one of a metal and a metal alloy, wherein said protective layer on sidewalls of said opening prevents electroplating of said one of said metal and said metal alloy, and an exposed portion of said metal-plating seed layer at said bottom surface of said opening promotes electroplating of said one of said metal and said metal alloy such that said electroplating process fills said opening with said electroplated layer from said bottom surface up, and wherein said forming of said protective layer comprises depositing a conformal additional metal layer over said metal-plating seed layer, wherein said additional metal layer is pre-selected to selectively prevent electroplating of said one of said metal and said metal alloy.

4. A method of forming a metal structure comprising:

forming an opening through a dielectric layer to a substrate;

lining said opening with a metal-plating seed layer;

forming a protective layer on said metal-plating seed layer;

removing said protective layer from a bottom surface of said opening; and performing an electroplating process to fill said opening with an electroplated layer comprising one of a metal and a metal alloy, wherein said protective layer on sidewalls of said opening prevents electroplating of said one of said metal and said metal alloy, and an exposed portion of said metal-plating seed layer at said bottom surface of said opening promotes electroplating of said one of said metal and said metal alloy such that said electroplating process fills said opening with said electroplated layer from said bottom surface up, and wherein said forming of said protective layer comprises depositing a conformal additional dielectric layer, wherein said additional dielectric layer is pre-selected to selectively prevent electroplating of said one of said metal and said metal alloy.

5. The method of claim 1, wherein said removing of said protective layer from said bottom surface of said opening comprises performing a directional etch process.

6. A method of forming an interconnect structure, said method comprising:

forming an opening through a dielectric layer to a substrate;

lining said opening with a copper-plating seed layer;

forming a protective layer on said copper-plating seed layer;

removing said protective layer from a bottom surface of said opening; and performing an electroplating process to fill said opening with an electroplated layer comprising one of copper and a copper alloy, wherein said protective layer on sidewalls of said opening prevents electroplating of said one of said copper and said copper alloy, and an exposed portion of said copper-plating seed layer at said bottom surface of said opening promotes electroplating of said one of said copper and said copper alloy such that said electroplating process fills with said opening with said electroplated layer from said bottom surface up, and wherein said forming of said protective layer comprises depositing a conformal layer of one of a metal and a metal alloy having a copper-plating over-potential sufficient to selectively prevent electroplating of said one of said copper and said copper alloy

7. The method of claim 6, further comprising:

providing said substrate;

forming said dielectric layer on said substrate such that said dielectric layer has a predetermined thickness; and patterning said opening in said dielectric layer such that an aspect ratio of said opening is greater than approximately 6:1.

8. The method of claim 6, wherein said metal comprises one of tantalum, tungsten, titanium, and chromium.

9. A method of forming an interconnect structure, said method comprising:

forming an opening through a dielectric layer to a substrate;

lining said opening with a copper-plating seed layer;

forming a protective layer on said copper-plating seed layer;

removing said protective layer from a bottom surface of said opening; and performing an electroplating process to fill said opening with an electroplated layer comprising one of copper and a copper alloy, wherein said protective layer on sidewalls of said opening prevents electroplating of said one of said copper and said copper alloy, and an exposed portion of said copper-plating seed layer at said bottom surface of said opening promotes electroplating of said one of said copper and said copper alloy such that said electroplating process fills with said opening with said electroplated layer from said bottom surface up, and wherein said forming of said protective layer comprises depositing a conformal layer of a dielectric having a copper-plating over-potential sufficient to selectively prevent electroplating of said one of said copper and said copper alloy.

10. The method of claim 6, wherein said removing of said protective layer from said bottom surface of said opening comprises performing a directional etch process.

11. The method of claim 6, wherein said performing of said electroplating process comprises using a copper-plating chemistry with additives to promote super-filling of said opening with said electroplated layer.

12. The method of claim 1, wherein said forming of said protective layer comprises depositing a conformal additional metal layer over said metal-plating seed layer, said additional metal layer having said metal-plating over-potential sufficient to selectively prevent said electroplating of said one of said metal and said metal alloy.

13. The method of claim 1, wherein said forming of said protective layer comprises depositing a conformal additional dielectric layer, said additional metal layer having said metal-plating over-potential sufficient to selectively prevent said electroplating of said one of said metal and said metal alloy.

14. The method of claim 1, further comprising, before said lining of said opening with said metal-plating seed layer, lining said opening with a baffler layer and an adhesion layer on said baffler layer.

15. The method of claim 14, wherein said lining of said opening with said metal-plating seed layer and said forming of said protective layer also forms a metal-plating seed layer-protective layer stack on a top surface of said dielectric layer, wherein said removing of said protective layer from said bottom surface of said opening also removes said protective layer from said stack; and wherein said performing of said an electroplating process to fill said opening with said electroplated layer also forms said electroplated layer above said top surface of said dielectric layer outside said opening.

16. The method of claim 3, further comprising:

providing said substrate;

forming said dielectric layer on said substrate such that said dielectric layer has a predetermined thickness; and patterning said opening in said dielectric layer such that an aspect ratio of said opening is greater than approximately 6:1.

17. The method of claim 3, wherein said removing of said protective layer from said bottom surface of said opening comprises performing a directional etch process.

18. The method of claim 4, further comprising:

providing said substrate;

forming said dielectric layer on said substrate such that said dielectric layer has a predetermined thickness; and patterning said opening in said dielectric layer such that an aspect ratio of said opening is greater than approximately 6:1.

19. The method of claim 4, wherein said removing of said protective layer from said bottom surface of said opening comprises performing a directional etch process.

20. The method of claim 9, further comprising:

providing said substrate;

forming said dielectric layer on said substrate such that said dielectric layer has a predetermined thickness; and patterning said opening in said dielectric layer such that an aspect ratio of said opening is greater than approximately 6:1.

21. The method of claim 9, wherein said removing of said protective layer from said bottom surface of said opening comprises performing a directional etch process.

22. The method of claim 9, wherein said performing of said electroplating process comprises using a copper-plating chemistry with additives to promote super-filling of said opening with said electroplated layer.

* * * * *